US005222741A

United States Patent [19]

Redl

[11] Patent Number: 5,222,741

[45] Date of Patent: Jun. 29, 1993

[54] TACTICAL TARGET SYSTEM

[75] Inventor: Mark S. Redl, Poughkeepsie, N.Y.

[73] Assignee: Mark Redl Inc., Poughkeepsie, N.Y.

[21] Appl. No.: 818,265

[22] Filed: Jan. 8, 1992

[51] Int. Cl.[5] ..... F41J 7/00

[52] U.S. Cl. ..... 273/393

[58] Field of Search ..... 273/393, 378, 380, 383, 273/384, 385, 386, 407, 408; 482/83, 84, 86, 87, 89, 90

[56] References Cited

U.S. PATENT DOCUMENTS

| | | | |
|---|---|---|---|
| 741,131 | 10/1903 | Hanson | 273/385 |
| 930,176 | 8/1909 | Hanft | 273/393 |
| 1,103,579 | 7/1914 | Hall | 273/407 |
| 1,366,004 | 1/1921 | Jacobs | 273/380 |
| 1,661,197 | 3/1928 | Richardson | 273/393 |
| 3,054,614 | 9/1962 | Dean | 273/374 |
| 4,487,583 | 12/1984 | Brucker et al. | 273/371 X |
| 4,505,481 | 3/1985 | Knight | 273/372 X |
| 4,934,937 | 6/1990 | Judd | 273/371 X |

*Primary Examiner*—William H. Grieb

*Attorney, Agent, or Firm*—Jacobson, Price, Holman & Stern

[57] ABSTRACT

A tactical target system and more specifically a target mannequin supported in a suspended manner from a support or supported from a stand or other type of support which includes an inflated balloon or bladder in a vital target area or target areas with the inflated balloon or bladder being connected to or engaged by a supporting structure which will release the mannequin and permit it to fall or collapse in a manner highly simulative of a person being struck by a bullet or other projectile when the balloon is deflated by being penetrated by a bullet or other projectile. The mannequin is constructed of foam plastic or similar material which has appearance characteristics similar to a human being and which can be provided with various articles of clothing and otherwise constructed to closely simulate a human being to provide a target which is quite effective in training various individuals such as law enforcement officers, military personnel and the like in using various weapons to develop and enhance their shooting skills.

11 Claims, 2 Drawing Sheets

TACTICAL TARGET SYSTEM

BACKGROUND OF THE INVENTION

1. Field of the Invention

The present invention generally relates to a tactical target system and more specifically a target mannequin supported in a suspended manner from a support or supported from a stand or other type of support which includes an inflated balloon or bladder in a vital target area or target areas with the inflated balloon or bladder being connected to or engaged by a supporting structure which will release the mannequin and permit it to fall or collapse in a manner highly simulative of a person being struck by a bullet or other projectile when the balloon is deflated by being penetrated by a bullet or other projectile. The mannequin is constructed of foam plastic or similar material which has appearance characteristics similar to a human being and which can be provided with various articles of clothing and otherwise constructed to closely simulate a human being to provide a target which is quite effective in training various individuals such as law enforcement officers, military personnel and the like in using various weapons to develop and enhance their shooting skills.

2. Description of the Prior Art

Practice shooting at targets is a well known form of training individuals in skillful handling and shooting of various weapons including handguns, rifles, shotguns and other weapons which are used to propel a projectile in a trajectory toward a target. In certain instances, such as when training law enforcement personnel, military personnel and the like, the target quite frequently is constructed to have the appearance characteristics of a human being which can be associated with various backgrounds to familiarize the trainee with various scenarios which may be encountered during normal performance of their duties. The simplest type of target is a stationary panel that may have the outline of a human being formed thereon or applied thereto with the panel being supported generally in a vertical position and in some instances, if the panel is struck, it will fall to a horizontal position. Various developments in target simulation have been made including moving targets and targets which closely resemble human beings. The following U.S. patents relate to the subject matter.

U.S. Pat. No. 930,176
U.S. Pat. No. 3,054,614
U.S. Pat. No. 4,487,583
U.S. Pat. No. 4,505,481
U.S. Pat. No. 4,934,937

While the above patents disclose various target structures including mannequins which change configuration when impacted by a projectile and a suspended target which is dislodged from a support when struck by a projectile in the form of a thrown ball, the prior art does not disclose an arrangement in which a target mannequin is supported by an inflated balloon arranged in a hollow internal space within the mannequin and associated therewith and an external support in such a manner that when a bullet or other projectile penetrates the mannequin and balloon, the balloon will deflate and release the mannequin from the support thus enabling the mannequin to collapse or fall in a manner which is very similar to the manner in which a human being would fall or collapse when struck in a vital area by a bullet or similar projectile.

SUMMARY OF THE INVENTION

An object of the present invention is to provide a tactical target system which includes a life-like mannequin connected with a supporting structure by an internal inflated balloon or bladder which connects the mannequin to a support and is located in a vital target area of the mannequin with the balloon being deflated when penetrated by a bullet or other projectile striking the mannequin in the vital target area thus disconnecting the mannequin from its support and enabling the mannequin to collapse or fall in a manner quite similar to the manner in which a human being would fall if struck by a bullet or other projectile in the same vital target area.

Another object of the invention is to provide a target mannequin which can be suspended from an overhead support or supported by a stand with the inflated balloon being engaged with the overhead support or stand with the association of the components releasing the mannequin from the support when the target area is struck by a bullet or other projectile and the balloon deflated due to penetration of the bullet or projectile.

A further object of the invention is to provide a target mannequin in which the mannequin closely simulates a human being and is constructed of resilient foam material or the like with the arms and legs being articulately connected thereto and being replacable in the event of damage during use.

Still another object of the invention is to provide a tactical target system in accordance with the preceding objects in which the mannequin includes a hollow head and chest cavity area receiving the inflated balloon or bladder with the balloon being closed by a suspension member which extends upwardly through a small opening in the head area of the mannequin with the enlarged inflated balloon holding the mannequin onto the suspension element while inflated but passing through the hole in the head of the mannequin when deflated thus releasing the mannequin from the overhead support.

A still further object of the invention is to provide a tactical target system in accordance with the preceding objects in which the mannequin is supported by an upwardly extending rod extending through a restricted opening into a hollow cavity in the chest and head region with the inflatable balloon maintaining the mannequin in elevated position on the support member with deflation of the inflatable balloon enabling the mannequin to drop vertically downwardly in relation to the support member.

A still further object of the invention is to provide a target mannequin which is relatively simple in construction, effective in developing shooting skills and relatively inexpensive to manufacture and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
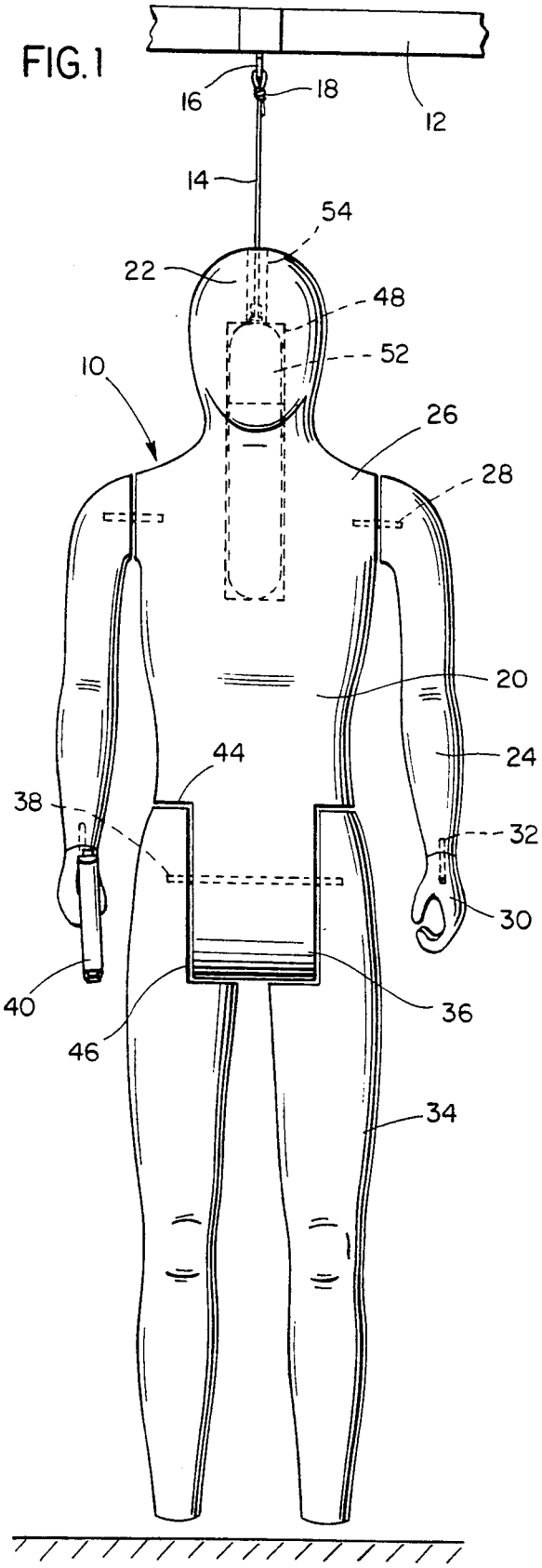
FIG. 1 is a front elevational view of the mannequin of the present invention illustrating its association with an overhead support.
Figure 2:
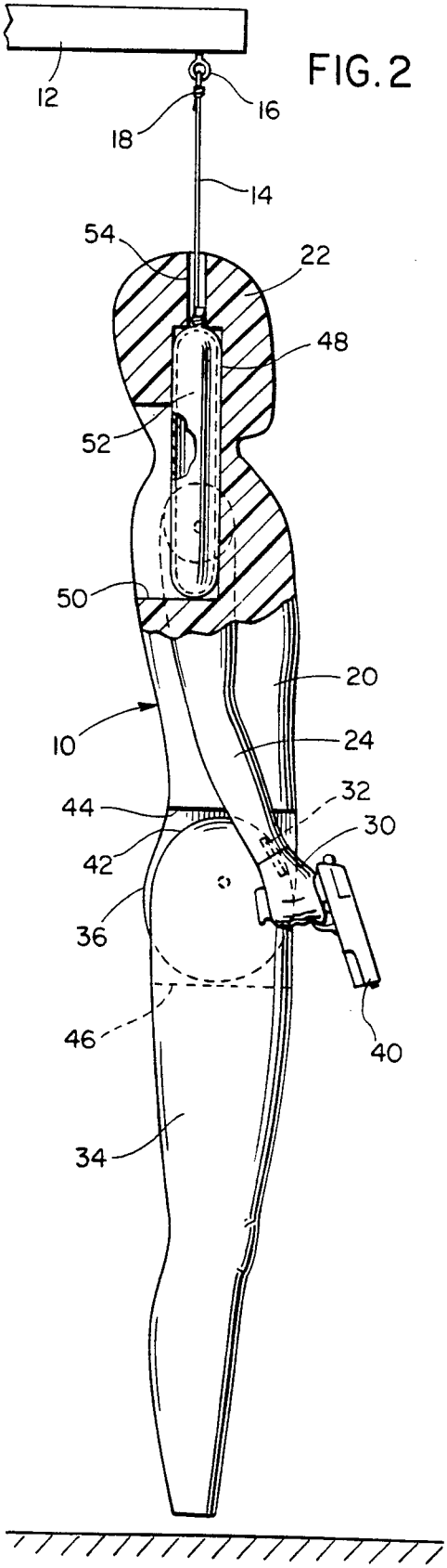
FIG. 2 is a side elevational view of the mannequin with portions broken away illustrating the hollow target area in the head and chest region with the inflatable balloon inserted through an opening therein and suspended from an overhead support by a flexible support member extending through a restricted opening in the simulated skull of the mannequin.
Figure 3:
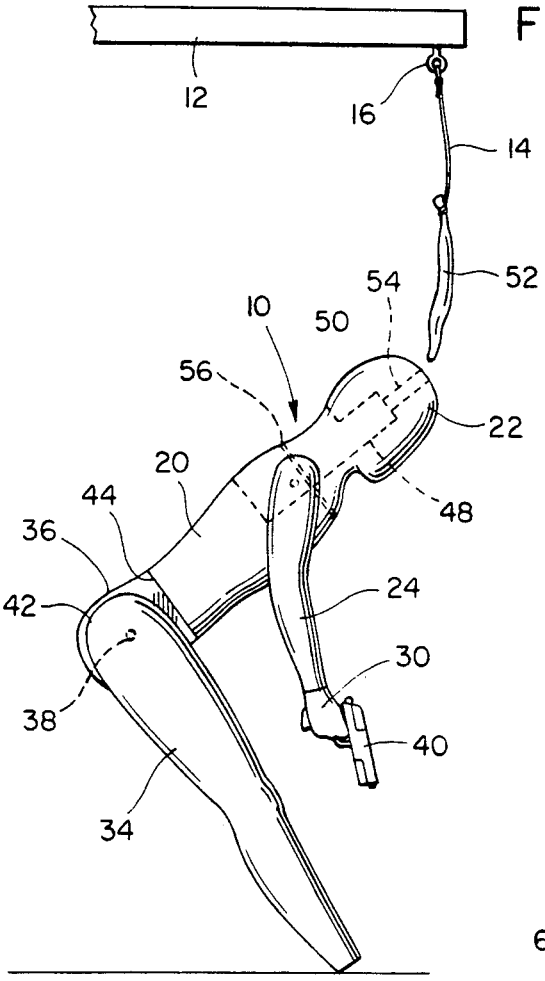
FIG. 3 is a schematic side elevational view illustrating the manner in which the mannequin is released from an overhead support so that it collapses or falls in a manner similar to a human being.

Referring to FIGS. 1-3, the tactical target system of the present invention is illustrated in the form of a target in the form of a mannequin 10 that is supported from an overhead support 12 of any suitable construction by the use of a support member in the form of a flexible line 14 such as a string, rope, cable or the like connected to an eye 16 in a conventional adjustable manner by the use of a conventional knot 18 or the like. The specific manner of supporting the mannequin 10 can vary with the flexible line 14 being relatively small in cross-sectional configuration but sufficiently strong to support the mannequin 10.

The mannequin 10 includes a supported member in the form of a torso 20 having a head 22 formed thereon. A pair of arms 24 are connected to the shoulder regions 26 by a connector 28 and a hand 30 is connected to the outer end of each of the arms 24 by a connector 32. A pair of legs 34 are connected to a depending central portion 36 of the torso by connectors 38. One or both of the hands 30 may be provided with a simulated weapon 40 such as a handgun. Also, the upper ends of the legs 34 may be rounded at 42 and are received in recesses 44 formed in the lower end of the torso 20 with the depending central portion 36 of the torso being received in recesses 46 formed in the inner upper surfaces of the legs 34 with the overall shape and contour of the mannequin 10 being that of an average size human being or other living animals with the overall dimensions of the mannequin being varied to more realistically simulate different size individuals or animals.

The torso 20 and head 22 include a target area in the form of a vertically disposed internal cavity 48 which is centrally oriented and extends vertically from a bottom end generally located in the area of vital organs in the torso 20 to a point generally in the central area of the vertical extent of the head 22 as illustrated in FIGS. 1 and 2. The rear surface of the torso 20 is provided with a vertically disposed access opening 50 which enables insertion of an elongated inflatable balloon or bladder 52 of flexible resilient puncturable material which, when inflated substantially fills the internal cavity 48. The flexible suspension line 14 extends vertically through a small passageway 54 extending from the upper end or crown of the head downwardly to communicate with the upper end of the internal cavity 48. The flexible line 14 can be tied around the inflatable end of the balloon 52 to retain the balloon closed and the flexible line 14 is tied to the supporting eye 16 to support the mannequin in elevated position in closely spaced relation to a floor surface as illustrated in order to support the mannequin in a manner to simulate a human being.

When the balloon 52 is inflated, it is substantially larger in cross-sectional area than the passageway 54 thus preventing the balloon from passing upwardly through the passageway 54. However, when a bullet or other projectile passes through or enters the internal cavity as indicated schematically by reference numeral 56 in FIG. 3, it will puncture the balloon 52 and cause it to deflate. When the balloon deflates, it is then capable of easily passing through the passageway 54 thus permitting the mannequin 10 to fall or collapse as illustrated in FIG. 3 with the articulate connections 28 and 38 enabling the arms 24 and legs 34 to pivot in relation to the torso as illustrated in FIG. 3 with the falling or collapse of the mannequin indicating that the bullet or other projectile has hit a vital target area represented by the internal cavity 48. When the mannequin 10 falls or collapses, it closely simulates the motion and activity of an individual who has been struck with a bullet or the projectile in a vital target area thereby providing a realistic target mannequin which will actually fall from a vertical "standing" position to a prone position in a manner quite similar to the manner in which a person would fall if struck by a bullet in a vital target area.

Figure 4:
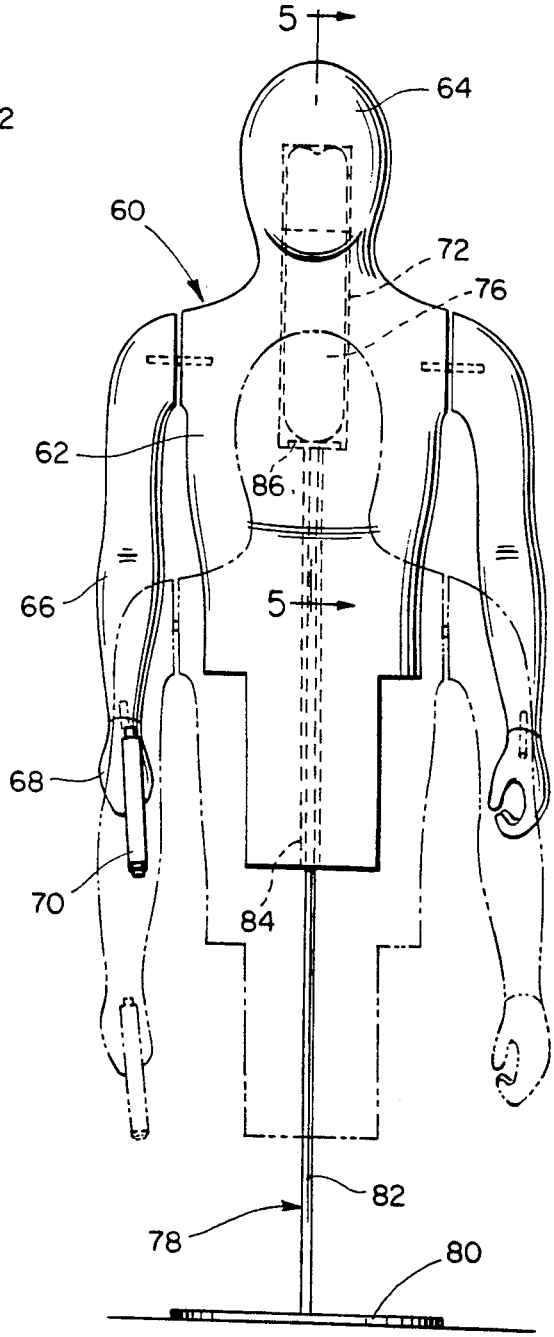
FIG. 4 is a front elevational view of another form of the invention in which the inflatable balloon in the interior of a mannequin is engaged with a support plate on the upper end of a stand to hold the mannequin in elevated position.
Figure 5:
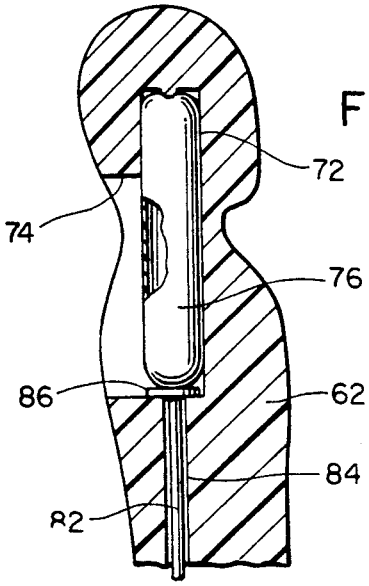
FIG. 5 is a vertical sectional view taken substantially upon a plane passing along section line 5—5 on FIG. 4 illustrating further structural details of this form of the invention.

The embodiment of the invention illustrated in FIGS. 4 and 5 includes a mannequin 60 having a torso 62 with a head 64 molded thereon and including arms 66, hands 68 and a simulated weapon 70 in a manner similar to the mannequin in FIGS. 1-3. Legs may also be provided on the torso 60 if desired. In this construction, the chest area and head includes an internal cavity 72 provided with an access opening 74 in the rear of the mannequin to enable insertion of an inflatable balloon or bladder 76. The mannequin in this embodiment of the invention is supported by a stand generally designated by reference numeral 78 and which includes a base 80 having a vertical standard 82 rigid therewith which extends up through a vertical passageway 84 extending upwardly from the bottom of the torso 62 to the bottom end of the internal cavity 72 as illustrated in FIG. 5. The upper end of the standard 82 is provided with a small plate 86 which engages the lower end of the inflated balloon or bladder 76 thereby supporting the mannequin by engagement of the plate 86 on the stand 78 with the lower end of the inflated balloon 76. When a bullet or projectile penetrates the vital target area occupied by the cavity 72, the balloon will be ruptured and deflated thus enabling the mannequin 60 to fall or collapse downwardly a vertical distance corresponding to the vertical height of the internal cavity 72 since the torso 62 will no longer be held at its upper position by the inflated balloon 76. This enables the mannequin to fall downwardly until the torso 62 comes to rest with the upper end of the cavity 76 engaging or disposed adjacent to plate 86. This embodiment of the mannequin also provides a life-like or realistic simulation of a person falling or partially falling as a result of being struck by a bullet or similar projectile.

In each embodiment of the invention, a target mannequin is supported by an inflated balloon or bladder arranged in a manner that when the target is struck by a bullet or other projectile in the area in which the balloon is positioned, the target mannequin will be released in response to deflation of the balloon thereby enabling the target mannequin to drop either to a supporting surface or to a lower collapsed position to closely simulate the action of a person struck by a bullet or projectile in a vital target area or ideal target area. This type of mannequin target can be effectively utilized by law enforcement agencies during target shooting or training. Preferably, the mannequin is molded from a foam plastic material such as ETHAFOAM which is "self-healing" and the mannequin includes a head, shoulders, chest area, pelvic girdle, arms, hands, legs and feet if desired with all of the component parts being assembled into a realistic mannequin which can be clothed to fit any scenario or description. If the components become unuseable after repeated bullet impact damage, they can be easily replaced by the separable articulate connectors. The inflated balloon which is contained in a hollow portion of the head and chest supports the mannequin either in a suspended arrangement or from a self supporting stand. Thus, when an accurately aimed bullet strikes the ideal target area in the head or chest area, the balloon will be broken thus disabling the support system and allowing the mannequin target to fall in a realistic manner. While the head and torso has been shown as being of an integral molded one-piece construction, the head could also be articulately connected to the torso in a manner that would enable the head and torso to swivel or pivot in relation to each other to render the mannequin more realistic in appearance by enabling the head and torso to be adjusted in relation to each other as well as the arms and legs being adjustable. This would enable the mannequin to be positioned with one arm raised to simulate a handgun being oriented in a raised position to simulate a target positioned in a mode in which a handgun is pointing generally in the direction of a person undergoing training to become more proficient at shooting at a target which can assume various positions.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A target for use in practice target shooting comprising a mannequin constructed in a manner to simulate a human being, means supporting said mannequin in a generally upright manner, and means located in a target are of the mannequin for disabling the means supporting said mannequin when the target area is struck by a projectile thereby releasing the mannequin from the means supporting said mannequin and permitting it to fall downwardly to simulate the action of a human being when struck by a projectile, said means supporting said mannequin including an internal cavity in said mannequin located in a target area of the mannequin, an inflated balloon in said cavity, said means supporting said mannequin also including means engaged with said balloon to support the mannequin in a generally upright elevated position when the balloon is inflated, said inflated balloon being ruptured by a projectile hitting and penetrating the target area on the mannequin thereby disabling the means supporting said mannequin to enable the mannequin to move vertically downwardly to simulate a human being struck by a projectile.

2. The target as defined in claim 1 wherein said means supporting said mannequin includes an overhead support, a depending flexible line connected to said overhead support, said mannequin including a passageway vertically through a head at the upper end of the mannequin, said flexible line being connected to a mouth end of said balloon with the balloon being larger in cross-sectional area than the passageway when inflated thus supporting the mannequin from the flexible line, said balloon, when deflated, being of smaller cross-sectional dimension than the passageway for movement of the balloon through the passageway deflated thereby enabling the mannequin to fall and collapse completely free of the balloon.

3. The target as defined in claim 1 wherein said means supporting said mannequin includes a supporting stand having a vertically extending support rod extending through a bottom opening passageway in said mannequin with the passageway communicating with the lower end of the internal cavity, the upper end of said rod including a support plate engaged with the inflatable balloon and sized to move vertically in the cavity whereby deflation of the balloon will permit the mannequin to move vertically downwardly as the plate moves upwardly in the cavity.

4. The target as defined in claim 1, wherein said mannequin includes an opening in the rear thereof in communication with the internal cavity to enable replacement of the inflated balloon in the internal cavity.

5. The target as defined in claim 1 wherein said mannequin is constructed of a foam material having external configuration and appearance characteristics which simulate a human being.

6. The target as defined in claim 5 wherein said mannequin includes a torso and arms articulately connected thereto, a hand articulately connected to each arm with the articulate connection enabling movement of the hands and arms and replacement of the components in the event of damage during use.

7. The target as defined in claim 6 wherein said mannequin also includes legs connected thereto by connectors enabling pivotal movement of the legs and replacement of the legs in the event of damage.

8. The target as defined in claim 1 wherein said internal cavity extends centrally of the mannequin in a lower portion of a head on the mannequin into the upper portion of a chest on the mannequin with the width of the cavity being sufficient to receive a balloon having a horizontal cross-sectional area that defines a vital target area.

9. A target for use in practice shooting comprising a mannequin configured to simulate a living animal, support means for said mannequin and means interconnecting the support means and mannequin which is released to permit the mannequin to fall when struck by a projectile, said means interconnecting the mannequin and the support means including a cavity formed in the mannequin in an area which contains vital organs of the simulated living animal, a balloon in the cavity to support the mannequin from the support means when the balloon is inflated and releasing the mannequin from the support means when the balloon is deflated.

10. A target for use in practice target shooting comprising means constructed in a manner to form a visually observable target having a target area, means supporting said target in an elevated position and means located in said target area of the target for visually indicating that the target area was struck by a projectile, said means supporting said target including a support member engaging a support externally of said target, a supported member on said target, said means located in said target area including an inflated puncturable member engaged with said support member and said supported member to support the target in said elevated position with puncture and deflation of the puncturable member when struck by a projectile permitting the supported member and said target to fall downwardly to visually indicate that the target are was struck by a projectile.

11. The target as defined in claim 10 wherein said means constructed in a manner to form a visually observable target being in the form of a mannequin which simulates a living animal having vital organs, the target area of the target being located in the area of the mannequin in which the vital organs are located, said mannequin including a cavity receiving said inflated puncturable member with the supported member forming a peripheral portion of said cavity and the puncturable member having a portion engaged with the supported member and a portion engaged with said support member with the puncturable member maintaining the supported member and target in elevated position and enabling the supported member and target to fall downwardly when the puncturable member is deflated.

* * * * *